US006474352B1

(12) United States Patent
Lee

(10) Patent No.: US 6,474,352 B1
(45) Date of Patent: Nov. 5, 2002

(54) WIND-PROOF UMBRELLA

(76) Inventor: Youth Lee, 8F-1, No. 69, Sec. 1, Hang-chou S. Road Wen-Pei Li, Chung-Cheng Area, Taipei City (TW)

( * ) Notice: Subject to any disclaimer, the term of this patent is extended or adjusted under 35 U.S.C. 154(b) by 0 days.

(21) Appl. No.: 09/896,489

(22) Filed: Jun. 29, 2001

(51) Int. Cl.[7] ..... A45B 25/22
(52) U.S. Cl. ..... 135/31; 135/33.7; 135/25.31
(58) Field of Search ..... 135/31, 27, 33.2, 135/33.7, 15.1, 16, 25.3, 25.31, 25.32, 25.33, 26

(56) References Cited

U.S. PATENT DOCUMENTS 1,249,007 A * 12/1917 Block
5,370,144 A * 12/1994 Yang ..... 135/25.31
5,553,634 A * 9/1996 Yang ..... 135/25.3
6,039,063 A * 3/2000 Lin et al. ..... 135/25.31
6,095,171 A * 8/2000 Lin et al. ..... 135/25.32
6,336,464 B1 * 1/2002 Ko ..... 135/25.31
6,390,108 B1 * 5/2002 Lin et al. ..... 135/33.41

* cited by examiner

*Primary Examiner*—Janet M. Wilkens
(74) *Attorney, Agent, or Firm*—Ostrolenk, Faber, Gerb & Soffen, LLP

(57) ABSTRACT

A wind-proof umbrella has secondary ribs pivotally connected with second linking ribs and having a flexibility the same as that of flexible ribs that are mounted between second joints on the second linking ribs and third joints on the outer supporting ribs. The secondary ribs are overlapped on top of the flexible ribs and able to pivot with respect to the flexible ribs so as to prevent a flip-over of the umbrella.

2 Claims, 4 Drawing Sheets

WIND-PROOF UMBRELLA

FIELD OF THE INVENTION

The present invention relates to a wind-proof umbrella, and more particularly to an umbrella having a primary cover with a centrally defined through hole and a secondary cover detachably connected with the primary cover and having an area sufficient enough to enclose the through hole. The primary cover is supported by outer supporting ribs and flexible ribs. The secondary cover is supported by supporting ribs divergently extending out from the shaft of the umbrella, first linking ribs, second linking ribs and outer supporting ribs. Secondary ribs each are pivotally connected with the first linking ribs so that the secondary cover is able to detach from the primary cover to allow strong air flow to flow through the gap between the primary cover and the secondary cover.

BACKGROUND OF THE INVENTION

A conventional wind-proof umbrella has a centrally defined through hole in the primary cover. A secondary cover is mounted on top of the-through hole and is movably engaged with the primary cover, such that when strong wind is blowing under the primary cover, the wind will push the secondary cover to move away from the primary cover so as to prevent the umbrella from flip-over.

However, this type of conventional wind-proof suffers several disadvantages such as:

1. Because the secondary is securely attached with the ribs of the umbrella, such that when the wind blows the secondary cover to disengage the secondary cover from the primary cover, the gap between the primary cover and the secondary cover is not sufficient to allow the escape of the wind. A potential flip-over of the umbrella still exists.

2. The structure of the conventional umbrella is weak so that it needs multiple strips to enhance the structure of the umbrella, which increases the cost of manufacture.

3. The engagement between the secondary cover and the primary cover lies on the weight of the secondary cover so that in order to ensure the rain will not seep inside the umbrella, the area of the secondary cover needs to be larger than the area of the through a hole of the primary cover, which needs a lot of fabric to make the secondary cover and thus increases the cost.

To overcome the shortcomings, the present invention intends to provide an improved wind-proof umbrella to mitigate or obviate the aforementioned problems.

SUMMARY OF THE INVENTION

The primary objective of the invention is to provide a wind-proof umbrella having a primary cover with a centrally defined through hole and a secondary cover detachably connected with the primary cover and having an area sufficient enough to enclose the through hole. The gap between the primary cover and the secondary cover is large enough to allow the escape of the strong wind so as to prevent flip-over of the umbrella.

Another objective of the invention is to provide a resilient rib to control the movement of the secondary cover so as to ensure the rain will not seep through the joint between the primary cover and the secondary cover.

Still, another objective of the invention is to provide an improved umbrella structure, which is able to fight against the strong wind.

In order to accomplish the foregoing objectives, the primary cover of the umbrella is supported by outer supporting ribs and flexible ribs. The secondary cover is supported by supporting ribs divergently extending out from the shaft of the umbrella, first linking ribs, second linking ribs and outer supporting ribs. Secondary ribs each are pivotally connected with the first linking ribs so that the secondary cover is able to detach from the primary cover to allow strong air flow to flow through the gap between the primary cover and the secondary cover.

Other objects, advantages and novel features of the invention will become more apparent from the following detailed description when taken in conjunction with the accompanying drawings.

DETAILED DESCRIPTION OF THE INVENTION

Figures 1, 1A:
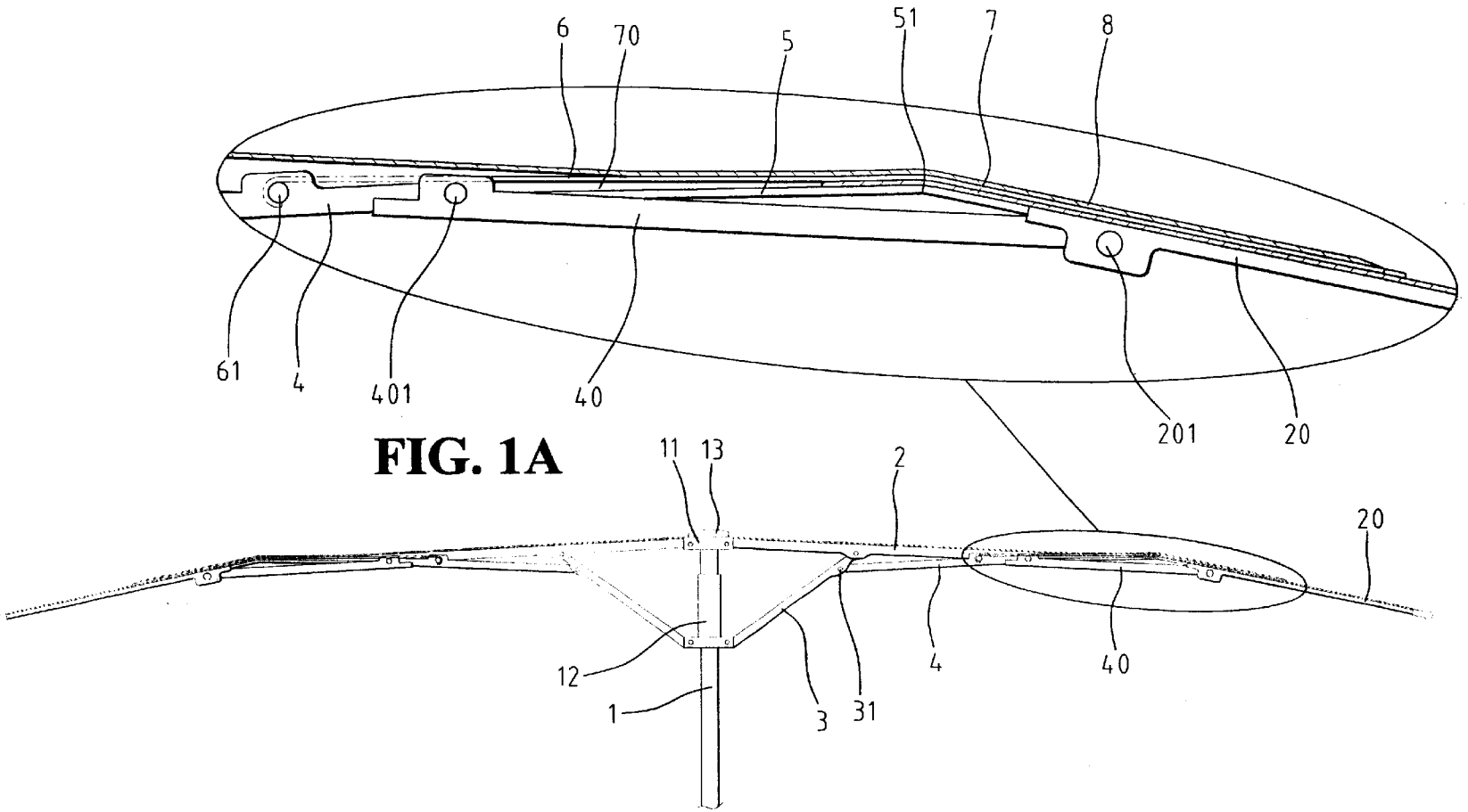
FIG. 1 is a side plan view of the structure of the umbrella of the invention.
FIG. 1A is an enlarged plan view showing the supporting member of the secondary cover.
Figure 2:
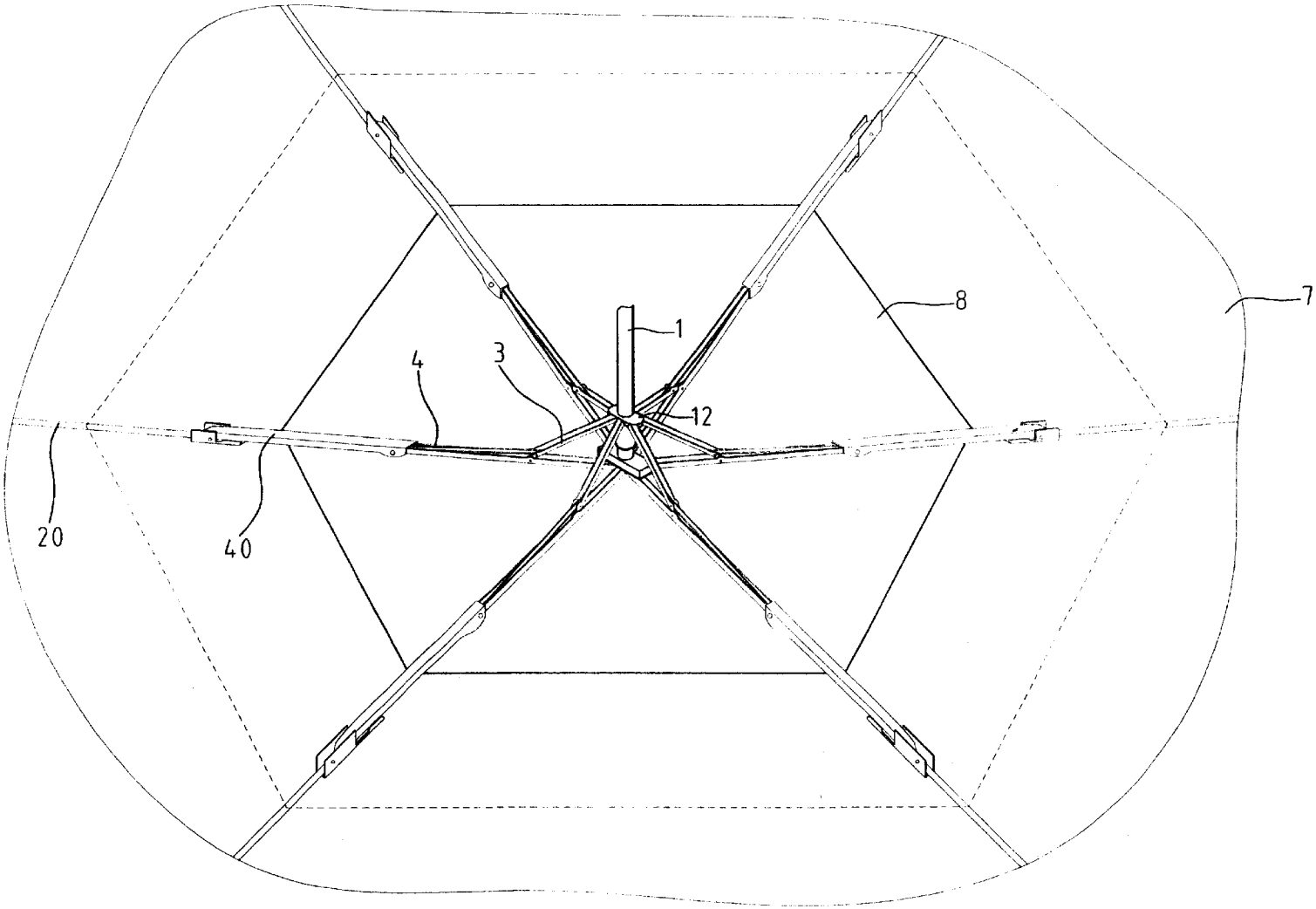
FIG. 2 is a bottom plan view of the structure of the umbrella of the invention.

With reference to FIGS. 1 and 1A, the umbrella in accordance with the present invention has a shaft 1 with a head 11 at a distal end of the shaft 1 and a nest 12 movably mounted on the shaft 1, multiple supporting ribs 2 radially extending out from the head 11, multiple bridging ribs 3 pivotally connected between the nest 12 and the supporting ribs 12, first linking ribs 4 each pivotally connected with a corresponding one of the bridging ribs 3 at a first joint 31 on the bridging rib 3, second linking ribs 40 each pivotally connected with a corresponding one of the first linking ribs 4 at a second joint 401 on the second linking rib 40, outer supporting ribs 20 each pivotally connected with a corresponding one of the second linking ribs 40 at a third joint 201. A flexible rib 5 is mounted between the second joint 401 and the third joint 201 and has a bend 51.

With such an arrangement as described above, the upward movement of the nest 12 along the shaft 1 drives the supporting ribs 2, the bridging ribs 3, the first linking ribs 4, the second linking ribs 40 and the outer supporting ribs 20 to move accordingly so as to form a bowl like shape.

Each of the first linking ribs 4 has a fourth joint 61 formed to pivotally connect a secondary rib 6 having the same flexibility as that of the flexible rib 5. A primary cover 7 is secured with and supported by the flexible ribs 5 and outer supporting ribs 20 and has a through hole 70 defined to have an area covered by the supporting ribs 20 and a portion of the flexible ribs 5. A center of a secondary cover 8 secured by a fastener 13 on the head 11 extends from the head 11 to the outer supporting ribs 20. That is. the through hole 70 is entirely covered by the secondary cover 8 and a portion of the primary cover 7 and the secondary cover 8 are overlapped with each other. Furthermore, the secondary ribs 6 are securely engaged with an outer periphery of the secondary cover 8.

Figure 3A:
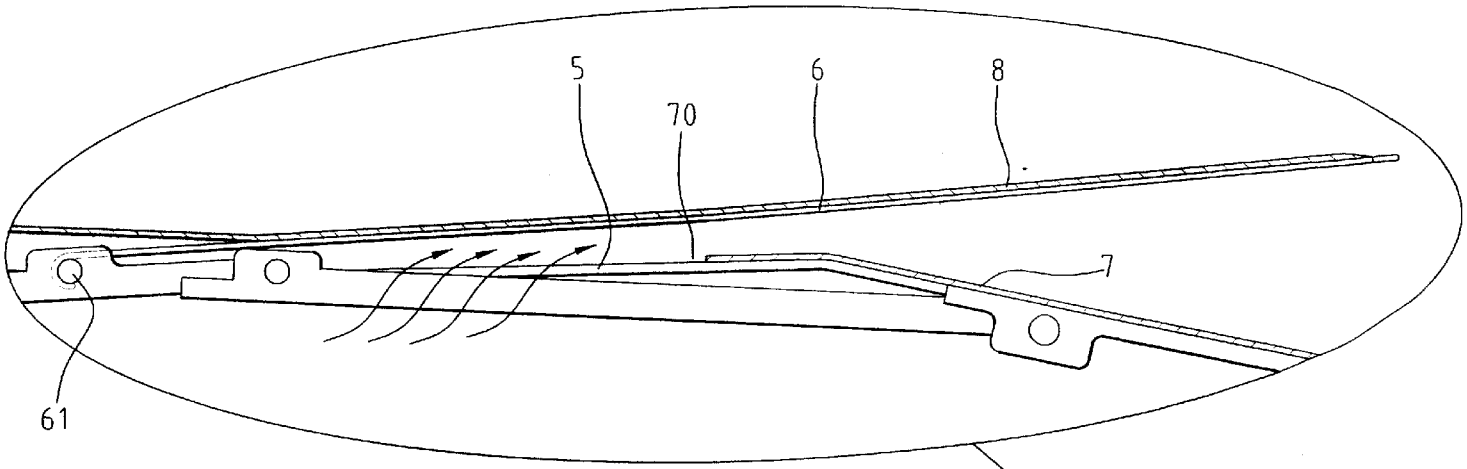
FIG. 3A is an enlarged side plan view showing the operation of the secondary cover with respect to the primary cover.
Figure 3:
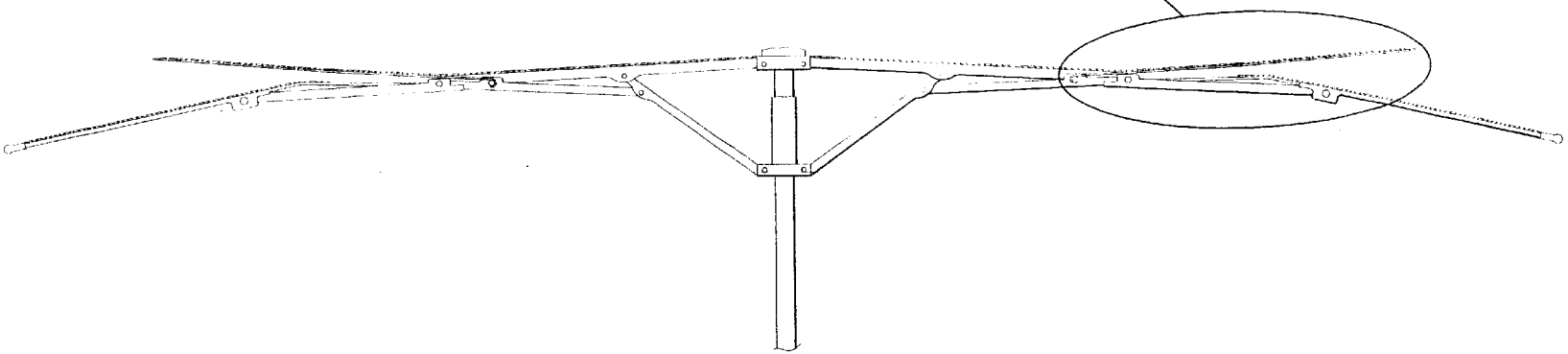
FIG. 3 is a side plan view showing the movement of the secondary cover.
Figure 4:
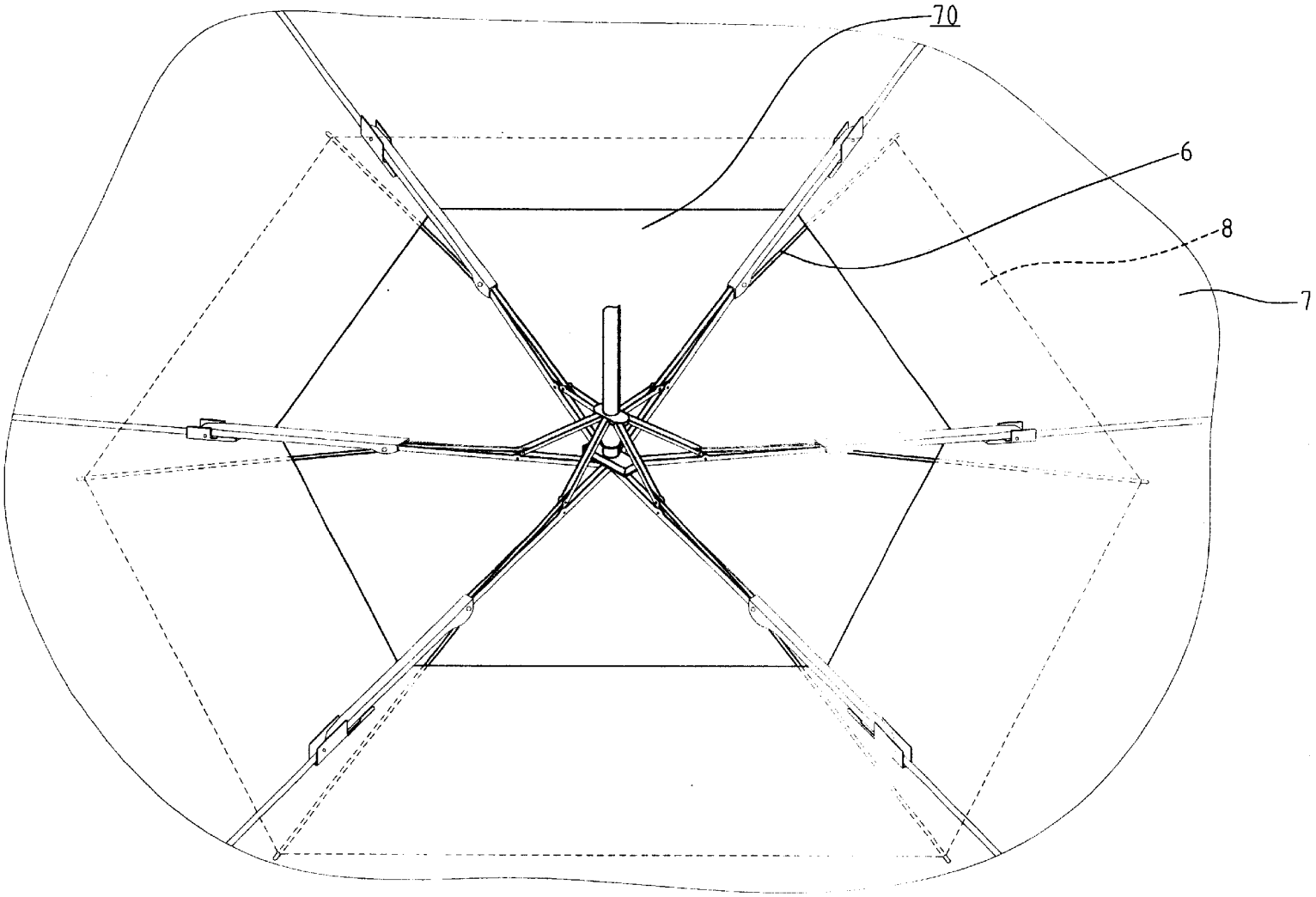
FIG. 4 is a bottom plan view showing the operation of the secondary cover with respect to the primary cover.

When the nest 12 move upward, each of the secondary ribs 6 overlaps on top of a corresponding one of the flexible ribs 5. Because the free ends of the secondary ribs 6 exceed over the bends 51, the free ends of the secondary ribs 6 extend downward so as to effectively prevent the rain from seeping into the through hole 70 of the primary cover 7 of the umbrella. When strong wind blows under the umbrella and the strength of the wind overcome the flexibility of the secondary ribs 6, the secondary ribs 6 pivot upward with respect to the primary cover 7 at the fourth joints 61 to define a gap between the primary cover 7 and the secondary cover 8, as shown in FIGS. 3, 3A and 4. Thus. the wind is able to flow through the through hole 70 and a flip-over of the umbrella is avoided.

Thereafter, the user only needs to push the umbrella forward against the air to use the air pressure to turn the secondary cover 8 back to engage with the primary cover 7 and cover the through hole 70 again.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A wind-proof umbrella comprising:

a shaft with a head at a distal end of the shaft and a nest movably mounted on the shaft;

multiple supporting ribs radially extending out from the head;

multiple bridging ribs pivotally connected between the nest and the supporting ribs;

first linking ribs each pivotally connected with a corresponding one of the bridging ribs at a first joint on the bridging rib;

second linking ribs each pivotally connected with a corresponding one of the first linking ribs at a second joint on the second linking rib;

outer supporting ribs each pivotally connected with a corresponding one of the second linking ribs at a third joint;

flexible ribs each mounted between the second joint and the third joint and having a bend;

a primary cover secured with and supported by the flexible ribs and outer supporting ribs and having a through hole defined to have an area covered by the supporting ribs and a portion of the flexible ribs;

a secondary cover secured by a fastener on the head extending from the head to the outer supporting ribs to cover the through hole and a portion of the primary cover, wherein each of the first linking ribs has a fourth joint formed to pivotally connect a secondary rib having the same flexibility as that of the flexible rib and securely engaged with an outer periphery of the secondary cover and wherein the secondary cover is detachably engaged with the primary cover.

2. The umbrella as claimed in claim 1, wherein the through hole has an area smaller than an area defined by the bends of the flexible ribs and the secondary cover has an area larger than the area defined by the bends of the flexible ribs.

* * * * *